US006246309B1

(12) United States Patent
Heinz et al.

(10) Patent No.: US 6,246,309 B1
(45) Date of Patent: Jun. 12, 2001

(54) POTTED DEVICE

(75) Inventors: Wolfgang Heinz; Dieter Maisch, both of Fellbach (DE)

(73) Assignee: IMI Norgren-Herion Fluidtronic GmbH & Co., KG, Fellbach (DE)

( * ) Notice: Subject to any disclaimer, the term of this patent is extended or adjusted under 35 U.S.C. 154(b) by 0 days.

(21) Appl. No.: 09/404,068

(22) Filed: Sep. 23, 1999

(30) Foreign Application Priority Data

Sep. 23, 1998 (DE) ..... 198 43 673

(51) Int. Cl.[7] ..... H01F 5/00; H01F 27/02
(52) U.S. Cl. ..... 335/299; 335/278; 336/96
(58) Field of Search ..... 336/96, 90–94, 336/98, 192; 335/202, 278, 282, 299

(56) References Cited

U.S. PATENT DOCUMENTS

| | | | | |
|---|---|---|---|---|
| 3,657,677 | * | 4/1972 | Hunt et al. | 336/96 |
| 4,412,196 | | 10/1983 | Teichert | 335/250 |
| 5,359,982 | * | 11/1994 | Taruya | 123/634 |
| 5,466,887 | * | 11/1995 | Hasegawa | 174/52.2 |

FOREIGN PATENT DOCUMENTS

| | | |
|---|---|---|
| 05 14 65 514 | 12/1969 | (DE) . |
| 90 03 343 | 7/1990 | (DE) . |
| 42 358 22 | 4/1993 | (DE) . |
| 0 187 902 | 7/1986 | (EP) . |
| 0662 696 | 7/1995 | (EP) . |

OTHER PUBLICATIONS

Leaflet No. 7501453–05.04.96 by Herion–Werke KG (German Version). No Date.
Leaflet No. 7501453–4/99 by IMI Norgren–Herion Fluidtronic GmbH & Co. KG (German and English Version). No Date.

* cited by examiner

*Primary Examiner*—Ramon M. Barrera
(74) *Attorney, Agent, or Firm*—Darby & Darby

(57) ABSTRACT

A potted device, especially a potted, explosion-protected electromagnet comprising a coil (70), preferably embedded in a potting compound (12) in a housing (10), and a ferromagnetic circuit (60), which can be connected to external lines via contact elements (20) arranged inside the housing and likewise embedded in the potting compound (12), is characterized by the fact that the contact elements (20) are arranged in a cavity in such a way as to protrude beyond the potting compound (12) that closes the housing off at its end face, the cavity being formed by a cover element that can be mounted on the housing in the area of the contact elements (20), and that a wiring duct, which is connected with the cavity, is provided in the potting compound.

2 Claims, 1 Drawing Sheet

POTTED DEVICE

BACKGROUND OF THE INVENTION

1. Field of the Invention

The present invention relates to a potted device, especially a potted, explosionprotected electromagnet comprising a coil, preferably embedded in a potting compound in a housing, and a ferromagnetic circuit, which can be connected to external lines via contact elements arranged inside the housing and likewise embedded in the potting compound.

2. Description of the Related Art

Potted devices have been known for a long time and are described, for example, by DE-G 90 03 343.4.

As it is a requirement for potted, explosion-protected electromagnets that the potting compound must ensure proper electric insulation to prevent any explosive gas mixture from reaching any ignition sources, and that the potting compound be capable of withstanding mechanical strains and of guarding the respective operational equipment from chemical influences, it is necessary to embed the contact elements, required for connecting external lines, in the potting compound as well. In addition it must be provided to arrange the contact elements inside the housing in a space separated from the surroundings, whereby it is additionally guaranteed that no explosive gas mixtures can reach the contact elements.

In the case of certain known devices, as described for example in Applicant's leaflet 7501453.05.04.96, the contact elements are arranged in a cavity of the housing that is accessible from the outside and can be opened, for example, by a plate.

Such an arrangement of the contact elements makes the operation of leading up the external lines and connecting them with the contact element(s) problematic and time-consuming, especially as tools, for example screwdrivers or the like, can be used inside the cavity of the housing only with great difficulty.

BRIEF SUMMARY OF THE INVENTION

Now, it is the object of the present invention to improve a potted device of the kind described in the preamble in such a way as to permit easy production and a simple structure and to ensure that the external lines can be easily led up to, and establish contact with, the contact elements.

This object is achieved with a potted device of the before-mentioned kind by the fact that the contact elements are arranged in a cavity in such a way as to protrude beyond the potting compound that closes the housing off at its end face, the cavity being formed by a cover element that can be mounted on the housing in the area of the contact elements, and that a wiring duct, which is connected with the cavity, is provided in the potting compound.

Making the contact elements protrude beyond the potting compound, that closes the housing off at its end face, and arranging a wiring duct, connected with the cavity, in the potting compound provides the particularly important advantage to facilitate the operation of leading up the external lines to the contact elements and to permit tools, such as screwdrivers or the like, to be optimally used.

Another advantage lies in the fact that the cavity in which the contact elements must be arranged to protect them from exposure to explosive gas mixtures or the like is formed by a preferably domed cover element that covers the housing in the area of the contact elements on its end face and that can be fixed to the housing after contact to the contact elements has been established. In combination with that cover element the protruding contact elements permit easy assembly of the external lines and an explosion-proof arrangement of the contact elements in the cavity formed by the cover element. It is understood that the cover element need not necessarily be domed, but may also exhibit any other shape providing a cavity. A still further advantage lies in the fact that due to the plane supporting surface of the cover a plane sealing element can be used.

As in many cases not only the contact elements but also circuits or other components, including fuses for example, must be embedded in the potting compound together with the contact elements, the coil and the ferromagnetic circuit, and as the thermoplastic compound is injected around those electric components at high pressure so that damage to the components cannot be excluded, it is provided in a very favorable embodiment that the contact elements and other electric components are arranged in a pot-shaped component that can be fixed in the housing, and are embedded in a thermoset molding compound. This ensures that especially the very delicate fuses will not be damaged.

The coil, the ferromagnetic circuit and the before-mentioned pot-shaped component, filled with the thermoset molding compound, are enclosed by a thermoplastic molding compound applied by injection molding.

BRIEF DESCRIPTION OF THE DRAWINGS

Further features and advantages of the invention will become apparent from the following description and from the illustration of one embodiment in the attached drawing. In the drawing

DETAILED DESCRIPTION OF THE INVENTION

Figure 1:
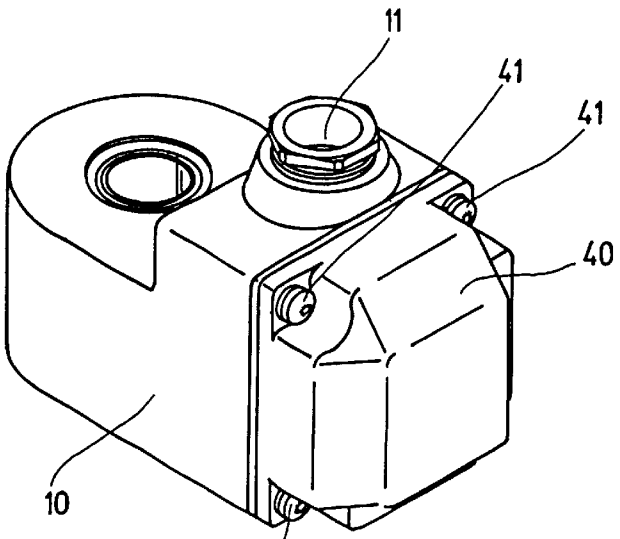
FIG. 1 shows a perspective representation of an explosion-protected electromagnet for valves according to the invention.
Figure 2:
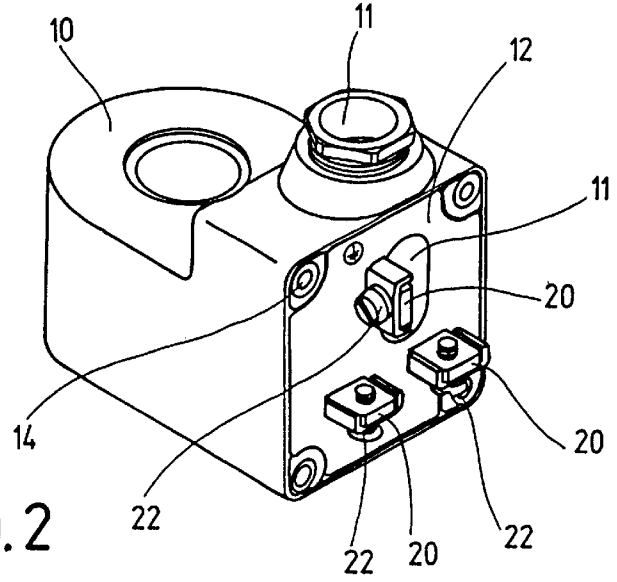
FIG. 2 shows a perspective representation of the electromagnet of FIG. 1, with the cover removed.
Figure 3:
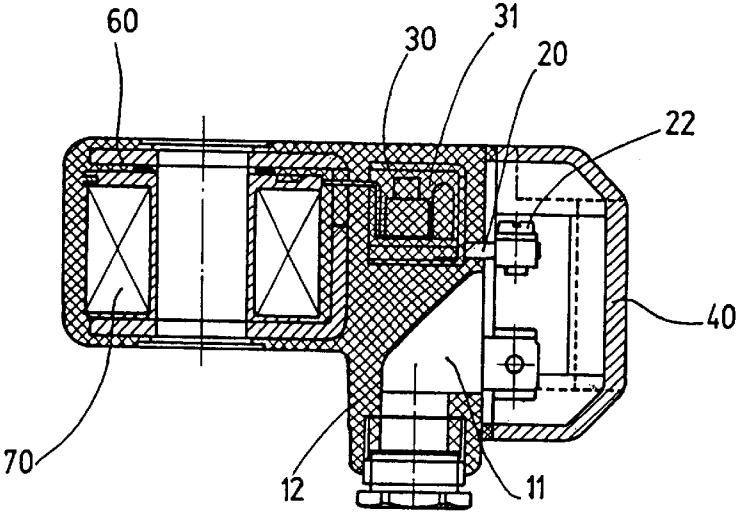
FIG. 3 shows a sectioned representation of the electromagnet of FIGS. 1 and 2.

A potted device in the form of an electromagnet, as represented in FIGS. 1 and 2, comprises a housing 10 made from a plastic material or metal, in which there are arranged a ferromagnetic circuit 60 and a coil 70, shown in FIG. 3, that can be connected to electric lines via contact elements 20.

As is apparent especially from FIGS. 1 and 3, the contact elements 20 are embedded in a potting compound 12 arranged in the housing 10, and project through the end face beyond the potting compound 12 that ends flush with the housing 10. In this way it is easily possible to connect the external lines, that are to be led up to the contact elements 20, in an electrically conductive way to the contact elements 20 by means of screw-clamping terminals 22.

In order to facilitate the operation of leading up the external lines to the screwclamping terminal 22 and, thus, to the contact elements 20, a wiring duct 11 is provided in the potting compound 12 that extends substantially from the contact elements 20 to the upper end face of the housing. Due to this wiring duct 11 a very compact design of the electromagnet is achieved because the cable can be led off in upward direction substantially in parallel to the direction of action of the electromagnet.

The housing cover 40 forming an explosion-protected cavity in which the contact elements 20 are arranged can be mounted to the end face of the housing by means of screws 41 that can be screwed into a thread 14 fixed on the housing 10.

The coil 70, the ferromagnetic circuit 60, the contact elements 20 and any further components are embedded in a molding compound. Preferably, a thermoplastic molding compound is injected at high pressure for embedding the ferromagnetic circuit 60 and the coil 70. If further electric components, such as fuses which often are pressure-sensitive and therefore unsuitable for being embedded by injection of the thermoplastic compound, are arranged in the housing 10, in addition to the contact elements 20, the ferromagnetic circuit 60 and the coil 70, then the contact elements 20 and those components are first placed in a pot-shaped component 30 that can be fixed inside the housing 10, and are then embedded in a thermoset molding compound 31. It is ensured in this way that these components will not be destroyed during embedding in the molding compound. The pot-shaped component 30 is then connected with the ferromagnetic circuit 60 and the coil 70 (see FIG. 3) whereafter it is finally embedded in the thermoplastic molding compound.

What is claimed is:

1. An electromagnetic device for use in an explosive environment comprising a housing, a coil in said housing, potting compound in said housing surrounding said coil, and having an external face, and a ferromagnetic circuit embedded in said potting compound, said coil having contacts extending beyond said face of said potting compound to permit connections to external leads, a cover for said housing to completely enclose said contacts, and a wiring duct extending through said potting compound and terminating at said face, said electromagnetic device further comprising further electrical components, a pot-shaped element in said housing receiving said further electrical components therein, and a thermosetting compound in said pot-shaped element surrounding said further electrical components.

2. An electromagnetic device as in claim 1, wherein said coil, said ferromagnetic circuit and said pot-shaped element are embedded in said potting compound, said potting compound comprising an injected thermoplastic compound.

* * * * *